US007232044B1

(12) United States Patent
Salmela

(10) Patent No.: US 7,232,044 B1
(45) Date of Patent: Jun. 19, 2007

(54) DISPOSABLE PIERCE FITTING

(75) Inventor: Juha K. Salmela, Citrus Heights, CA (US)

(73) Assignee: Automatic Bar Controls, Inc., Vacaville, CA (US)

( * ) Notice: Subject to any disclaimer, the term of this patent is extended or adjusted under 35 U.S.C. 154(b) by 397 days.

(21) Appl. No.: 10/713,646

(22) Filed: Nov. 13, 2003

(51) Int. Cl.
*B67D 5/00* (2006.01)

(52) U.S. Cl. ..... 222/83; 222/90

(58) Field of Classification Search ..... 222/83, 222/90

See application file for complete search history.

(56) References Cited

U.S. PATENT DOCUMENTS 1,528,283 A * 3/1925 Whitesides ..... 222/90
1,971,284 A * 8/1934 Stockman ..... 222/90
3,114,480 A * 12/1963 Sauter ..... 222/90
2004/0104246 A1* 6/2004 Kawaguchi et al. ..... 222/83

* cited by examiner

*Primary Examiner*—Philippe Derakshani
(74) *Attorney, Agent, or Firm*—Townsend and Townsend and Crew LLP

(57) ABSTRACT

Embodiments of the present invention are directed to a pierce fitting or member for penetrating a container to access the interior of the container. The pierce fitting is configured to cut a flap through the surface of the container. In one embodiment, a device for penetrating a container to access an interior of the container comprises a pierce member including an external surface and an internal surface forming a hollow interior extending between a proximal end and a distal end. The distal end has a slanted surface with a pierce leading edge on a first side between the external surface and the internal surface. The external surface expands outwardly in a region proximal of the distal end in a direction toward the proximal end except on a second side opposite from the first side.

23 Claims, 4 Drawing Sheets

DISPOSABLE PIERCE FITTING

CROSS-REFERENCES TO RELATED APPLICATIONS

NOT APPLICABLE

BACKGROUND OF THE INVENTION

The present invention relates generally to dispensing apparatus and methods and, more particularly, to a device and a method for penetrating a container to access the interior of the container for dispensing the content therein.

Dispensing apparatus dispense flowable materials such as beverages and condiments from sources that are provided in the form of bags, jugs, containers, or the like. A bag typically requires a box for support or a hook for hanging. In some cases, it is beneficial to use a more rigid container than a bag so as to eliminate the need for a support box or a hook. Different fittings are needed for coupling a flow line to different containers to pump the materials from the containers. It is desirable to provide a fitting that is easy and quick to use, and is cost effective to manufacture.

BRIEF SUMMARY OF THE INVENTION

Embodiments of the present invention are directed to a pierce fitting or member for penetrating a container to access the interior of the container. The pierce fitting is configured to cut a flap through the surface of the container. The pierce fitting has a portion that expands outwardly to cut and push the flap into the interior of the container as the fitting is inserted into the container, and another portion that does not expand outwardly so as not to sever the flap completely from the container. The portion that does not expand outwardly may be a planar surface which bends the flap inwardly when the pierce fitting is inserted and lodged onto the container. A tubing is inserted through the interior of the pierce fitting to access the content of the container.

In accordance with an aspect of the present invention, a device for penetrating a container to access an interior of the container comprises a pierce member including an external surface and an internal surface forming a hollow interior extending between a proximal end and a distal end. The distal end has a slanted surface with a pierce leading edge on a first side between the external surface and the internal surface. The external surface expands outwardly in a region proximal of the distal end in a direction toward the proximal end except on a second side opposite from the first side.

In some embodiments, the external surface of the pierce member expands outwardly to form a tapered external surface portion in the region proximal of the distal end except on the second side. The tapered external surface portion of the pierce member ends with a barb oriented toward the proximal end. The external surface of the pierce member includes a flange disposed proximal of and spaced from the barb to form a groove therebetween. The second side opposite from the first side of the pierce member includes a generally planar surface which is perpendicular to a plane extending between the first side and the second side. The internal surface of the pierce member is substantially circular cylindrical. The internal surface of the pierce member includes one or more barbs oriented to permit a tubing to be inserted inside the pierce member only in a direction from the proximal end to the distal end. The internal surface of the pierce member may include one or more air grooves extending between the proximal end and the distal end. The internal surface of the pierce member may include an enlarged internal region having a larger bore size near the distal end than the interior near the proximal end of the pierce member.

In specific embodiments, a tubing is inserted into the pierce member. The tubing includes an enlarged portion near the distal end of the pierce member, the larger bore size near the distal end accommodating the enlarged portion of the tubing. The enlarged portion is larger in size than the interior of the pierce member near the proximal end to prevent the enlarged portion from passing through the pierce member in a direction from the distal end toward the proximal end. A lock ring insert is inserted into the tubing to form the enlarged portion. An insertion tool has a cavity to receive a portion of the pierce member near the proximal end. The insertion tool has an enlarged body and is detachably coupled with the pierce member. The insertion tool may include a cutout extending proximally from the proximal end of the pierce member.

In accordance with another aspect of the invention, a device for penetrating a container to access an interior of the container comprises a pierce member including an external surface and an internal surface forming a hollow interior extending between a proximal end and a distal end. The distal end has a pierce leading edge on a first side between the external surface and the internal surface. The external surface of the pierce member expands outwardly in a region proximal of the distal end in a direction toward the proximal end, except on a second side opposite from the first side, to form a tapered external surface portion in the region proximal of the distal end. The external surface of the pierce member on the second side does not expand outwardly.

In accordance with another aspect of the present invention, a method of penetrating a container to access an interior of the container comprises providing a pierce member which includes an external surface and an internal surface forming a hollow interior extending between a proximal end and a distal end. The distal end has a pierce leading edge on a first side between the external surface and the internal surface. The external surface expands outwardly in a region proximal of the distal end in a direction toward the proximal end except on a second side opposite from the first side. The method further comprises piercing a surface of the container with the pierce leading edge of the pierce member and cutting a flap from the surface of the container by pushing the distal end of the pierce member through the surface. The second side of the pierce member bears against and bends the flap toward the interior of the container without severing the flap from the container.

In some embodiments, the method further comprises, prior to piercing the surface of the container with the pierce leading edge of the pierce member, inserting a tubing into the interior of the pierce member, and enlarging a distal region of the tubing to form an enlarged portion on a side disposed near the distal end of the pierce member to prevent the enlarged portion of the tubing from passing through the pierce fitting in a direction from the distal end toward the proximal end. Enlarging the distal region of the tubing comprises inserting a lock ring insert into the distal region of the tubing.

DETAILED DESCRIPTION OF THE INVENTION

Figure 4:
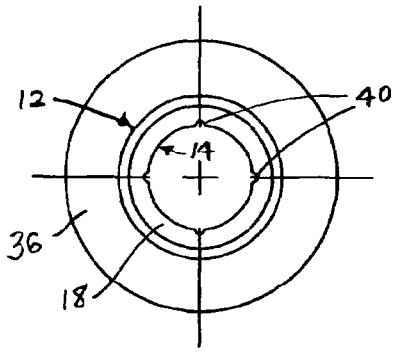
FIG. 4 is a top plan view of the pierce fitting of FIG. 1.
Figure 1:
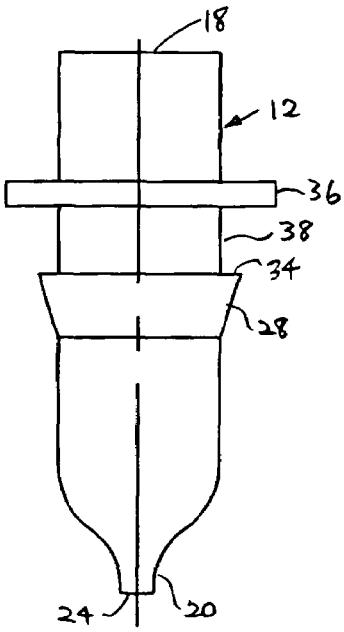
FIG. 1 is a front elevational view of the pierce fitting according to an embodiment of the present invention.
Figure 2:
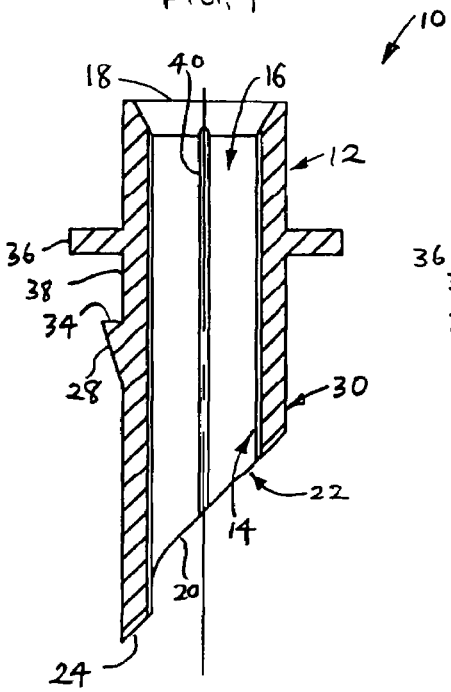
FIG. 2 is a side cross-sectional view of the pierce fitting of FIG. 1.
Figure 3:
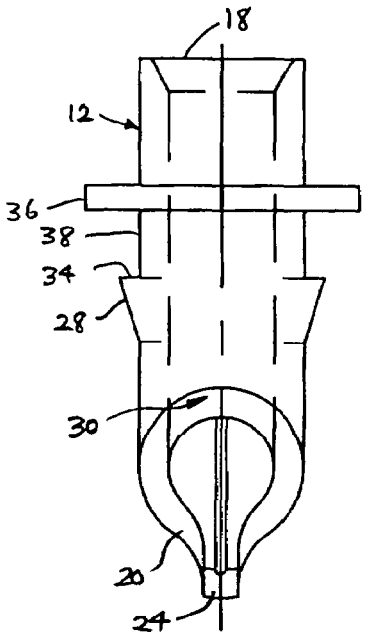
FIG. 3 is a rear elevational view of the pierce fitting of FIG. 1.
Figure 5:
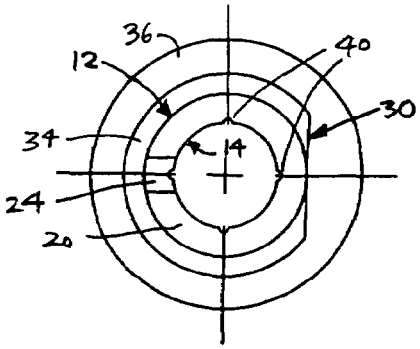
FIG. 5 is a bottom plan view of the pierce fitting of FIG. 1.

FIGS. 1–5 show a pierce fitting or member 10 for penetrating a container to access the interior of the container. The pierce fitting 10 includes an external surface 12 and an internal surface 14 forming a hollow interior 16 which extends between a proximal end 18 and a distal end 20. The distal end 20 desirably includes a slanted surface 22 with a pierce leading edge 24 on a first side and formed between the external surface 12 and internal surface 14 of the pierce fitting 10. The slanted surface 22 makes an angle of about 45° with respect to a horizontal plane across a transverse section of the pierce fitting 10, but the angle may vary between a shallow incline of a few degrees to a sharp incline to greater than 70°. The external surface 12 expands outwardly in a region proximal of the distal end in a direction toward the proximal end 18 to form a tapered external surface portion 28, except on a second side opposite from the first side. On the second side, the external surface 12 does not expand. In the specific embodiments shown, the second side includes a generally planar surface 30 which is perpendicular to a plane extending between the first side and the second side, as best seen in FIGS. 3 and 5. The tapered external surface portion 28 of the pierce fitting 10 ends with a barb 34 oriented toward the proximal end 18. The external surface 12 includes a flange 36 disposed proximal of and spaced from the barb 34 to form a groove or slot 38 therebetween. As shown in FIGS. 4–5, the internal surface 14 of the pierce member 10 is substantially circular cylindrical. A plurality of air grooves or paths 40 extend between the proximal end 18 and the distal end 20 of the pierce member 10. The air grooves 40 are typically straight, but may be nonlinear in other embodiments. The pierce fitting 10 may be made of a variety of materials such as plastics.

Figure 6:
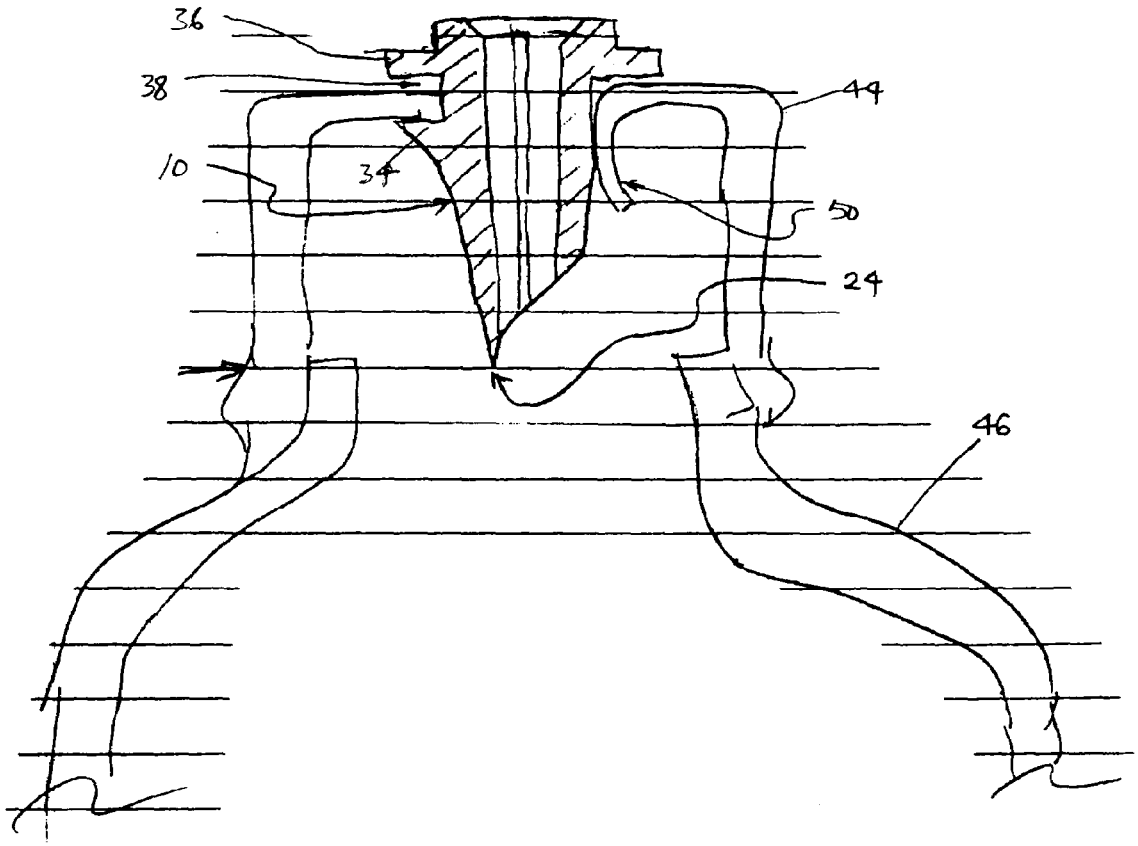
FIG. 6 is a cross-sectional view of a container pierced through by the pierce fitting of FIG. 1.

FIG. 6 shows the insertion of the pierce fitting 10 through a surface such as the cap 44 of a container 46. During insertion, the pierce leading edge 24 begins cutting a flap 50 from the cap 44. The cutting of the flap 50 continues as the slanted distal end 20 pushes through the cap 44, bending the flap 50 inward from the first side to the second side of the pierce fitting 10. The cutting stops after reaching the second side where the expansion of the external surface 12 ends. For instance, the second side has a generally planar surface 30 which bears against and bends the flap 50 toward the interior of the container 46 without severing the flap 50 from the container 46. As illustrated in FIG. 6, the portion of the cap 44 from which the flap 50 is cut is lodged into the groove 38 of the pierce fitting 10 between the barb 34 and the flange 36.

Figure 7:
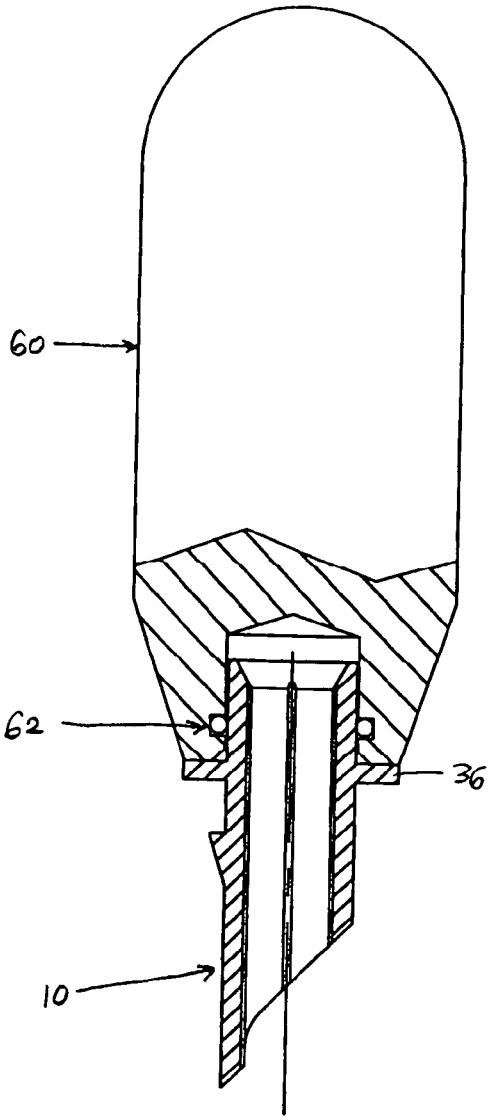
FIG. 7 is a partial cross-sectional view of an insertion tool coupled to the pierce fitting of FIG. 1 according to one embodiment.

An insertion tool 60 may be used to insert the pierce fitting 10 through the cap 44 of the container 46. As shown in FIG. 7, the insertion tool 60 has an enlarged body, and is engaged with the proximal end 18 of the pierce fitting 10 to form a handle that is easier for a user to grip and push the pierce fitting 10 to pierce the container cap 44. In this embodiment, an O-ring 62 is disposed between the insertion tool 60 and the outer surface 12 of the pierce fitting 10 as a temporary retaining member during insertion. The insertion tool 60 of FIG. 7 is suitable for inserting a pierce fitting 10 prior to inserting a tubing into the pierce fitting 10.

Figure 7A:
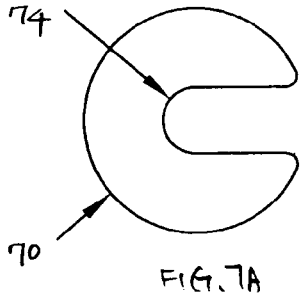
FIG. 7A is a top plan view of an insertion tool according to another embodiment.
Figure 7B:
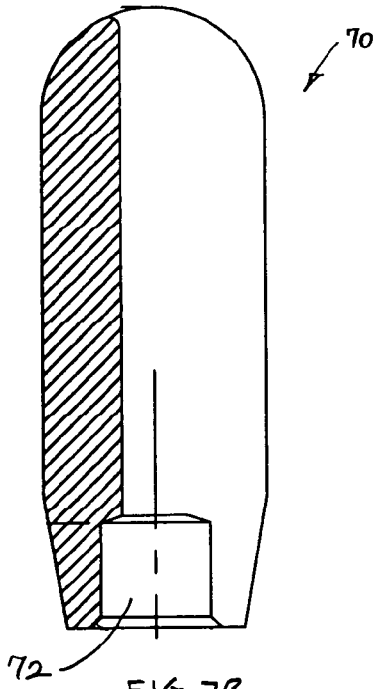
FIG. 7B is a front cross-sectional view of the insertion tool of FIG. 7A.
Figure 7C:
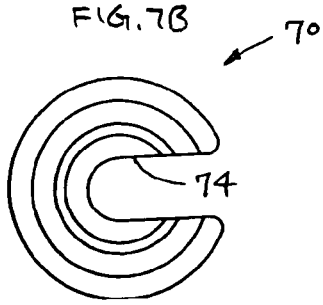
FIG. 7C is a bottom plan view of the insertion tool of FIG. 7A.

FIGS. 7A–7C show an insertion tool 70 according to another embodiment. The insertion tool 70 has a cavity 72 that fits over the proximal end 18 of the pierce fitting 10. A cutout 74 extends proximally from the proximal end of the pierce fitting 10, and is provided to accommodate a tubing which is inserted into the pierce fitting 10. The cutout 74 allows the insertion tool 70 to insert the pierce fitting 10 with the tubing and then be removed from the pierce fitting 10 and the tubing. The cutout 74 in this embodiment extends the entire length of the tool 70, but may extend only partially along the length of the tool in other embodiments. No O-ring is needed as a retaining member for this embodiment.

Figure 10:
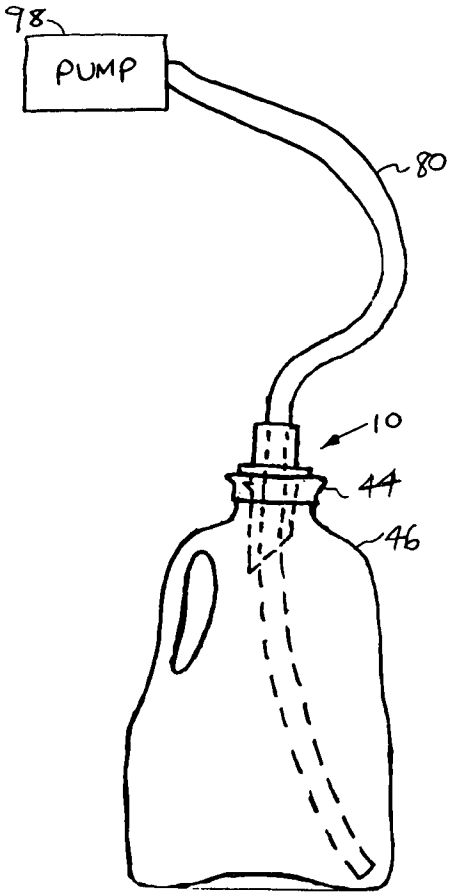
FIG. 10 is an elevational view schematically illustrating an apparatus for penetrating a container to access the interior of the container using the pierce fitting of FIG. 1.
Figure 9:
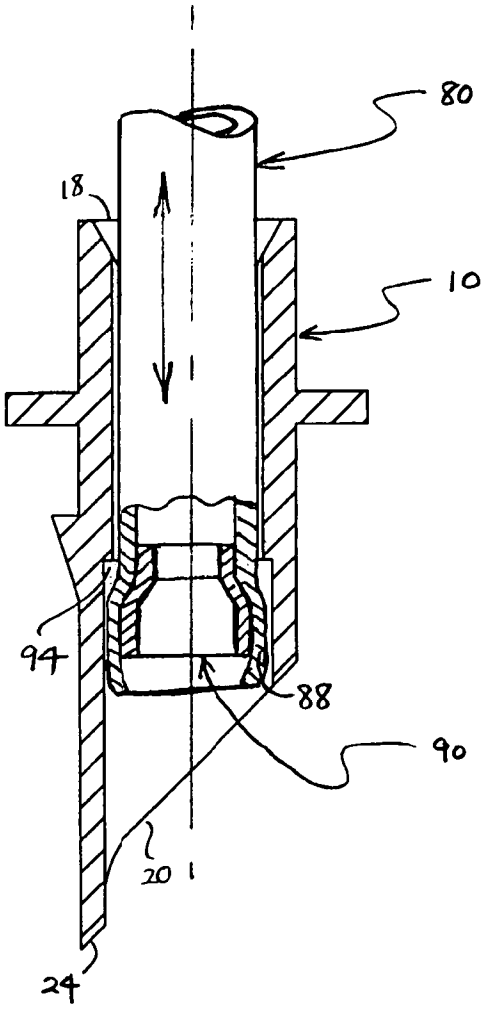
FIG. 9 is a partial cross-sectional view illustrating a lock ring insert for a tubing inserted through a pierce fitting according to another embodiment of the invention.
Figure 8:
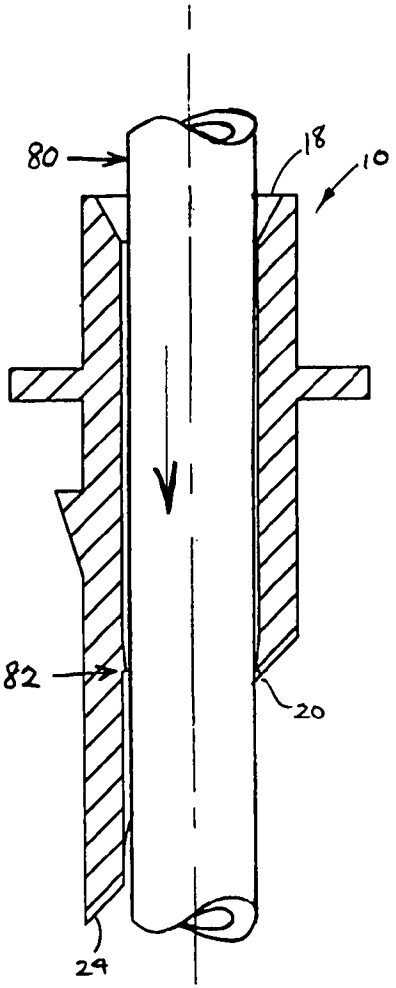
FIG. 8 is a partial cross-sectional view illustrating insertion of a tubing through a pierce fitting having barbs according to an embodiment of the invention.

FIGS. 8–10 show the insertion of a tubing 80 through the interior 16 of the pierce fitting 10 to access the interior of the container 46. The tubing 80 may be made of a variety of materials, such as a soft plastic. In the embodiment shown in FIG. 8, the tubing 80 is inserted from the proximal end 18 to the distal end 20 of the pierce fitting 10. The internal surface 14 of the pierce fitting 10 includes one or more unidirectional barbs 82 oriented to prevent the tubing 80 from being withdrawn in the opposite direction from the distal end 20 toward the proximal end 18 of the pierce fitting 10. In the embodiment of FIG. 8, the tubing 80 is typically inserted through the pierce fitting 10 after the pierce fitting 10 is inserted and lodged onto the container 46. Alternatively, the tubing 80 may be inserted partially through the pierce fitting 10 before inserting the pierce fitting 10, and then inserted fully into the container 46 after the pierce fitting 10 is lodged onto the container 46.

In the embodiment shown in FIG. 9, the tubing 80 includes an enlarged portion 88 on a side disposed near the distal end 20 of the pierce member 10. The enlarged portion 88 may be formed by inserting a lock ring insert 90 into a distal region of the tubing 80. The lock ring insert 90 may be made of a hard plastic material. The lock ring insert 90 may be inserted into a plastic tubing 80 by heating the distal portion of the tubing 80 to soften the plastic material. The enlarged portion 88 prevents the tubing 80 from passing through the interior of the pierce fitting 10 in a direction from the distal end 20 toward the proximal end 18. The enlarged portion 88 may be formed prior to inserting the tubing 80 into the interior of the pierce fitting 10 from the distal end 20 toward the proximal end 18. Alternatively, the tubing 80 may be inserted from the proximal end 18 through the distal end 20 prior to forming the enlarged portion 88. The internal surface 14 of the pierce fitting 10 desirably includes an enlarged internal region 94 such as a counterbore having a larger bore size near the distal end 20 than the interior near the proximal end 18. The enlarge internal region 94 accommodates the enlarged portion 88 of the tubing 80, allowing the distal end 20 to pierce through the container cap 44 without interfering with the cutting process. The use of the enlarged portion 88 in the tubing 80 of FIG. 9 allows the tubing 80 to slide in both direction as opposed to the unidirectional barbs 82 used in the embodiment shown in FIG. 8.

As shown in FIG. 10, the distal end of the tubing 80 is inserted into the interior of the container 46. The proximal end of the tubing 80 may be connected to a pump 98 or the like. The pierce fitting 10 may be disposable with the container 46 after the content of the container 46 is emptied.

The above-described arrangements of apparatus and methods are merely illustrative of applications of the principles of this invention and many other embodiments and modifications may be made without departing from the spirit and scope of the invention as defined in the claims. The scope of the invention should, therefore, be determined not with reference to the above description, but instead should be determined with reference to the appended claims along with their full scope of equivalents.

What is claimed is:

1. A device for penetrating a container to access an interior of the container, the device comprising:

a pierce member including an external surface and an internal surface forming a hollow interior extending between a proximal end and a distal end, the distal end having a slanted surface with a pierce leading edge on a first side between the external surface and the internal surface, the external surface expanding outwardly in a region proximal of the distal end in a direction toward the proximal end except on a second side opposite from the first side.

2. The device of claim 1 wherein the external surface of the pierce member expands outwardly to form a tapered external surface portion in the region proximal of the distal end except on the second side.

3. The device of claim 2 wherein the tapered external surface portion of the pierce member ends with a barb oriented toward the proximal end.

4. The device of claim 3 wherein the external surface of the pierce member includes a flange disposed proximal of and spaced from the barb to form a groove therebetween.

5. The device of claim 1 wherein the second side opposite from the first side of the pierce member includes a generally planar surface which is perpendicular to a plane extending between the first side and the second side.

6. The device of claim 1 wherein the internal surface of the pierce member is substantially circular cylindrical.

7. The device of claim 1 wherein the internal surface of the pierce member includes one or more barbs oriented to permit a tubing to be inserted inside the pierce member only in a direction from the proximal end to the distal end.

8. The device of claim 1 wherein the internal surface of the pierce member includes one or more air grooves extending between the proximal end and the distal end.

9. The device of claim 1 wherein the internal surface of the pierce member includes an enlarged internal region having a larger bore size near the distal end than the interior near the proximal end of the pierce member.

10. The device of claim 9 further comprising a tubing inserted into the pierce member, the tubing including an enlarged portion near the distal end of the pierce member, the larger bore size near the distal end accommodating the enlarged portion of the tubing, the enlarged portion being larger in size than the interior of the pierce member near the proximal end to prevent the enlarged portion from passing through the pierce member in a direction from the distal end toward the proximal end.

11. The device of claim 10 further comprising a lock ring insert which is inserted into the tubing to form the enlarged portion.

12. The device of claim 1 further comprising an insertion tool having a cavity to receive a portion of the pierce member near the proximal end, the insertion tool having an enlarged body and being detachably coupled with the pierce member.

13. The device of claim 12 wherein the insertion tool includes a cutout extending proximally from the proximal end of the pierce member.

14. A device for penetrating a container to access an interior of the container, the device comprising:

a pierce member including an external surface and an internal surface forming a hollow interior extending between a proximal end and a distal end, the distal end having a pierce leading edge on a first side between the external surface and the internal surface;

wherein the external surface of the pierce member expands outwardly in a region proximal of the distal end in a direction toward the proximal end, except on a second side opposite from the first side, to form a tapered external surface portion in the region proximal of the distal end; and wherein the external surface of the pierce member on the second side does not expand outwardly.

15. The device of claim 14 wherein the tapered external surface portion of the pierce member ends with a barb oriented toward the proximal end.

16. The device of claim 15 wherein the external surface of the pierce member includes a flange disposed proximal of and spaced from the barb to form a groove therebetween.

17. The device of claim 14 wherein the second side of the pierce member includes a generally planar surface which is perpendicular to a plane extending between the first side and the second side.

18. A method of penetrating a container to access an interior of the container, the method comprising:

providing a pierce member which includes an external surface and an internal surface forming a hollow interior extending between a proximal end and a distal end, the distal end having a pierce leading edge on a first side between the external surface and the internal surface, the external surface expanding outwardly in a region proximal of the distal end in a direction toward the proximal end except on a second side opposite from the first side; and piercing a surface of the container with the pierce leading edge of the pierce member and cutting a flap from the surface of the container by pushing the distal end of the pierce member through the surface, the second side of the pierce member bearing against and bending the flap toward the interior of the container without severing the flap from the container.

19. The method of claim 18 wherein the external surface of the pierce member expands outwardly to form a tapered external surface portion in the region proximal of the distal end, the tapered external surface portion ending with a barb oriented toward the proximal end; wherein the external surface of the pierce member includes a flange disposed proximal of and spaced from the barb to form a groove therebetween; and further comprising lodging a portion of the surface of the container from which the flap is cut into the groove between the barb and the flange.

20. The method of claim 18 wherein the second side of the pierce member includes a generally planar surface which is perpendicular to a plane extending between the first side and the second side; and wherein the generally planar surface of the second side bears against and bends the flap toward the interior of the container without severing the flap from the container.

21. The method of claim 18 further comprising inserting a tubing through the pierce member from the proximal end toward the distal end; wherein the internal surface of the pierce member includes one or more barbs oriented to prevent the tubing from being withdrawn in a direction from the distal end toward the proximal end of the pierce member.

22. The method of claim 18 further comprising, prior to piercing the surface of the container with the pierce leading edge of the pierce member:

inserting a tubing into the interior of the pierce member;

enlarging a distal region of the tubing to form an enlarged portion on a side disposed near the distal end of the pierce member to prevent the enlarged portion of the tubing from passing through the pierce fitting in a direction from the distal end toward the proximal end.

23. The method of claim 22 wherein enlarging the distal region of the tubing comprises inserting a lock ring insert into the distal region of the tubing.

* * * * *